US005205251A

United States Patent [19]

Conklin

[11] Patent Number: 5,205,251

[45] Date of Patent: Apr. 27, 1993

[54] ROTARY VALVE FOR INTERNAL COMBUSTION ENGINE

[75] Inventor: Ronald J. Conklin, Grosse Pointe Woods, Mich.

[73] Assignee: IBEX Technologies, Inc., Grosse Pointe Farms, Mich.

[21] Appl. No.: 926,122

[22] Filed: Aug. 5, 1992

[51] Int. Cl.[5] ..... F01L 7/02

[52] U.S. Cl. ..... 123/190.12; 123/190.1; 123/190.8; 123/190.2

[58] Field of Search ..... 123/190.1, 190.12, 190.2, 123/190.4, 190.8

[56] References Cited

U.S. PATENT DOCUMENTS

| | | | |
|---|---|---|---|
| 286,803 | 10/1883 | Fletcher | 123/190.4 |
| 1,010,189 | 11/1911 | Sears | 123/190.1 |
| 1,117,095 | 11/1914 | Rothchild et al. | 123/80 BA |
| 1,122,529 | 12/1914 | Moss | 123/80 BA |
| 1,126,998 | 3/1915 | Heinze, Jr. | 123/80 BA |
| 1,171,834 | 2/1916 | Brower | 123/598 L |
| 1,181,974 | 5/1916 | Blye | 123/80 BA |
| 1,299,264 | 4/1919 | Thayer | 123/80 BA |
| 1,386,477 | 8/1921 | Wallace | 123/347 |
| 1,396,912 | 11/1921 | Asbury | 123/80 BA |
| 1,578,581 | 3/1926 | Casna | 123/190.2 |
| 1,599,530 | 9/1926 | Hogan | 123/71 V |
| 1,619,226 | 3/1927 | Werbitzky | 123/80 BA |
| 1,695,348 | 12/1928 | Scheel | 123/80 BA |
| 1,808,671 | 6/1931 | Luyckx | 123/80 R |
| 1,871,502 | 8/1932 | De Loach | 123/190.6 |
| 1,890,326 | 12/1932 | Hansen | 123/190.2 |
| 1,917,816 | 7/1933 | Spears | 123/190.2 |
| 1,997,491 | 4/1935 | Kemp | 123/190.2 |
| 2,437,181 | 7/1946 | Baker | 123/190.8 |
| 3,301,236 | 1/1967 | Bratton | 123/598 L |
| 3,526,216 | 9/1970 | Henvaux | 123/190 B |
| 3,730,161 | 5/1973 | Deane | 123/190 B |
| 3,945,364 | 3/1976 | Cook | 123/190 BD |
| 3,948,227 | 4/1976 | Guenther | 123/190.2 |
| 3,993,036 | 11/1976 | Tischler | 123/190.1 |
| 4,019,487 | 4/1977 | Guenther | 123/190.2 |
| 4,036,184 | 7/1977 | Guenther | 123/190.1 |
| 4,077,382 | 3/1978 | Gentile | 123/190 A |
| 4,119,077 | 10/1978 | Vallejos | 123/190 R |
| 4,163,438 | 8/1979 | Guenther | 123/190.1 |
| 4,201,174 | 5/1980 | Vallejos | 123/190 R |
| 4,421,077 | 12/1983 | Ruggeri | 123/190 BD |
| 4,481,917 | 11/1984 | Rus et al. | 123/190.12 |
| 4,572,116 | 3/1986 | Hedelin | 123/190 B |
| 4,864,985 | 2/1989 | Slee | 123/190 BA |
| 4,879,979 | 11/1989 | Triguero | 123/190 BB |
| 4,920,934 | 5/1990 | Pizzicara | 123/190 B |

*Primary Examiner*—E. Rollins Cross
*Assistant Examiner*—Erick Solis
*Attorney, Agent, or Firm*—Harness, Dickey & Pierce

[57] ABSTRACT

There is provided a rotary valve system for an internal combustion engine which has the capabilities of advancing of retarding the openings of the valves. The rotary valves comprise a cylindrical valve body rotatably disposed within a valve sleeve. The valve sleeve is rotatably disposed within the head of the internal combustion engine. Both intake and exhaust functions have a rotary valve. Under normal operation, the valve sleeve and body rotate at the same speed opening intake or exhaust ports at the appropriate times. Advancing or retarding of the valve timing is accomplished by varying the rotational velocity of either the valve body or the valve sleeve which in turn rotates the valve sleeve relative to the valve body to either advance or retard the opening of the appropriate port. A second embodiment has a valve sleeve which is normally stationary but is also selectively rotatable to effect the valve timing. Another embodiment of the invention rotates the valve body and/or sleeve at a nonuniform rate to increase the duration which the valve is in an open condition.

24 Claims, 2 Drawing Sheets

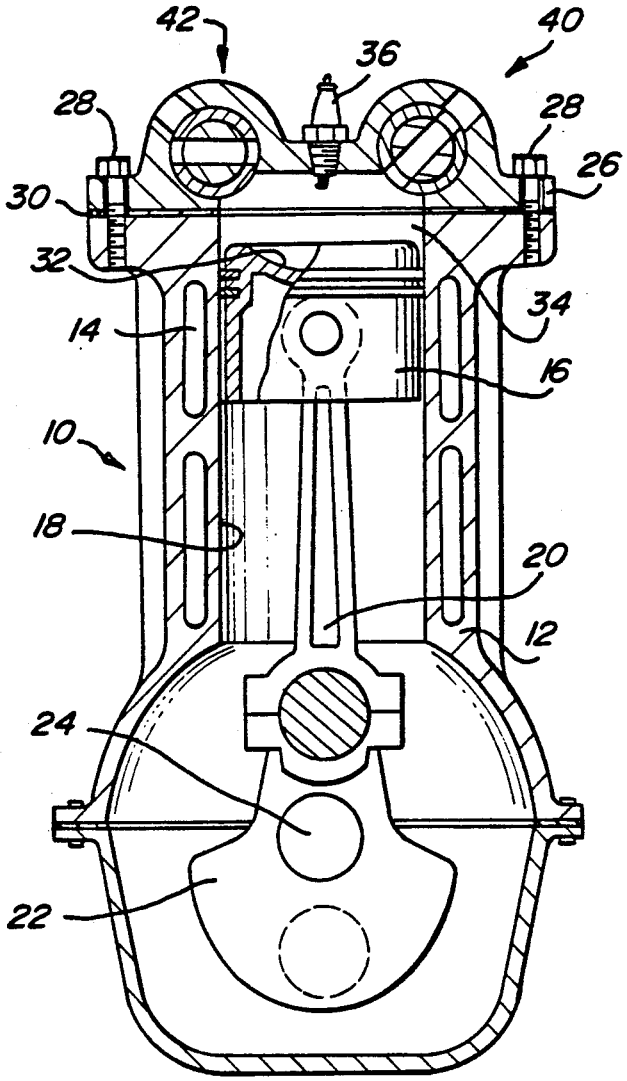
Fig-1
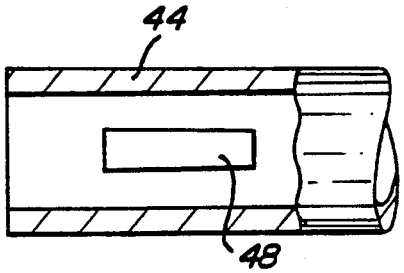
Fig-3
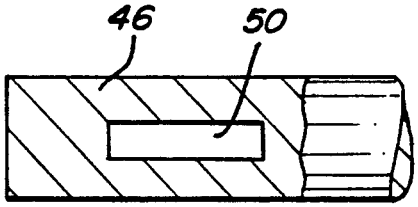
Fig-4
Fig-2
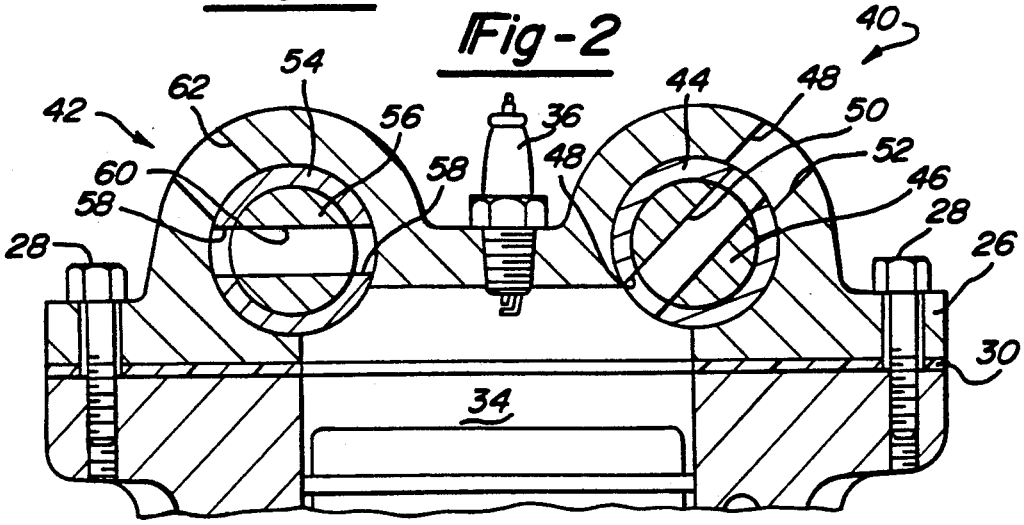

ROTARY VALVE FOR INTERNAL COMBUSTION ENGINE

FIELD OF THE INVENTION

The present invention relates to a rotary valve for an internal combustion engine provided with one or more piston cylinders. More particularly, the present invention relates to a rotary valve for an internal combustion engine capable of advancing or retarding the input or exhaust functions of the rotary valve.

BACKGROUND OF THE INVENTION

An operating cycle of an internal combustion engine, as is well known in the art, consists of four phases in the 4-stroke Otto cycle correspond to respective piston strokes. These four stages comprises an intake phase for the aspiration of an explosive air/fuel mixture, a compression and ignition phase, an expansion or power phase and an exhaust phase. These internal combustion engines employ poppet type valves which require valve operating trains including valve springs, camshaft, etc. in order to convert the rotary motion of the engine into the linear movement required by the poppet valves. These poppet valves are normally opened by movement mechanically inwardly of a cylinder in which they are placed by means of a rocker arm actuated by a push rod which in turn has been actuated by hydraulic lifters or the like driven from a camshaft in synchronism with the operation of the engine. Valve return has usually been by spring means. While a cam in head engine eliminates the push rods that are otherwise required, the cam mechanism does include levers and springs for maintaining the valves in a closed position.

Conventional poppet valves have various problems associated with them. A conventional poppet valve engine requires considerable power to overcome the resistance to opening the valves against cylinder pressure. The application of the necessary power to open the valves produces wear in the valve train. Further, the members of the valve train are reciprocating. Thus power is dissipated in overcoming the inertia of the members in changing their direction. Such valve structure also requires additional hood height and is inefficient at high speeds. Further, since the valve in the train are constantly exposed to the high temperature of the ignited fuel in the cylinders, burning of the valves as sustained high speed operation is possible.

The timing of the opening of the intake and exhaust valve of an internal combustion engine equipped with conventional poppet valves is inflexible once established by the design of the camshaft. The desire of an engine for an intake charge, however, is different at high RPM and high load than it is at low speed and light load, or an idle and the effect of gas momentum at these dissimilar operating modes has a significant effect on performance, fuel economy and emissions.

At high engine speeds and moderate to heavy loads, a lengthy intake valve opening duration is required to permit efficient breathing and maximum power. Early opening of the valve during the intake stroke increases the length of time the valve is open during the early part of the stroke and late closing allows the charge momentum to continue filling the cylinder even though the piston is moving upward on the compression stroke. During high load operation the exhaust gasses exit the cylinder with such intensity that a relative vacuum can occur at the end of the exhaust stroke. An early intake valve opening can then be advantageous in obtaining increased volumetric efficiency.

During low engine speed and light load operation, the situation changes and the pressure of the exhaust gasses in the cylinder exceeds the pressure in the intake manifold so that early valve opening of the valve results in exhaust gasses entering the intake system, diluting the fresh mixture and reducing combustion efficiency. This is particularly significant an idle since the fuel system must compensate for this dilution with an extra rich mixture which increases fuel consumption and also the probability of increased emissions. Late closing of the intake valve at low to medium speeds and light to medium loads, where charge momentum does not at least counteract the piston's upwards push on the intake charge, results in already inducted intake charge being pushed back into the intake system and reduces the compression of the intake charge and the engine efficiency.

Inflexible valve timing, therefore, forces the engine designer to compromise in areas of performance, fuel economy and emissions since these areas are linked to and partially dependent on valve timing and improvements in one area usually result in deterioration in at least one of the others.

Engines incorporating rotary valves have proven superior in certain respects in that they can be made with larger valve openings and are not limited by restrictions imposed by camshaft configurations, such as the necessary rise and fall times of the poppet valve operating cams. Also, such rotary valve engines are basically simpler in that they eliminate the need for valve operating trains.

Although rotary valves have proven superior in certain respects, as mentioned above, the typical rotary valve engine suffers from the problems of fixed valve timing due to the design of the head ports and circumferential valve body openings. Accordingly, what is required is a design of a rotary valve system which also incorporates the ability to advance or retard the valve opening timing to better accommodate the various operating requirements of the engine.

SUMMARY OF THE INVENTION

The present invention discloses a rotary valve system with means for effecting variable timing of opening, variable duration and variable timing of closing in response to changes in the engine's desire for an intake charge. This invention comprises a valve body rotatable within a rotation sleeve. The rotatable sleeve normally is allowed to rotate at the same speed as the valve body or it can be stationary. In both embodiments, the sleeve is adjustable in order to affect the valve timing.

One object of the present invention is to mitigate or eliminate the necessity for the above described design compromises permitting the design and manufacture of a higher performance, lower emissions and lower specific fuel consumption engine than comparably sized fixed timing engines, or previously proposed variable timing engines, by providing a rotary valve with means for effecting variable timing of opening, variable duration and variable timing of closing in response to the engine cylinder's desire for an intake charge.

Additional objects, advantages and features of the present invention will become apparent from the following description and the appended claims taken in conjunction with the accompanying drawings.

DESCRIPTION OF THE DRAWINGS

FIG. 1 is a transverse sectional view through an internal combustion engine embodying one form of the present invention.

FIG. 2 is an enlarged cross sectional view of the head portion of the engine shown in FIG. 1.

FIG. 3 is a side view, partially in cross section, of the outer sleeve shown in FIGS. 1 and 2.

FIG. 4 is a side view, partially in cross section, of the valve body shown in FIGS. 1 and 2.

DESCRIPTION OF THE PREFERRED EMBODIMENT

Figure 5:
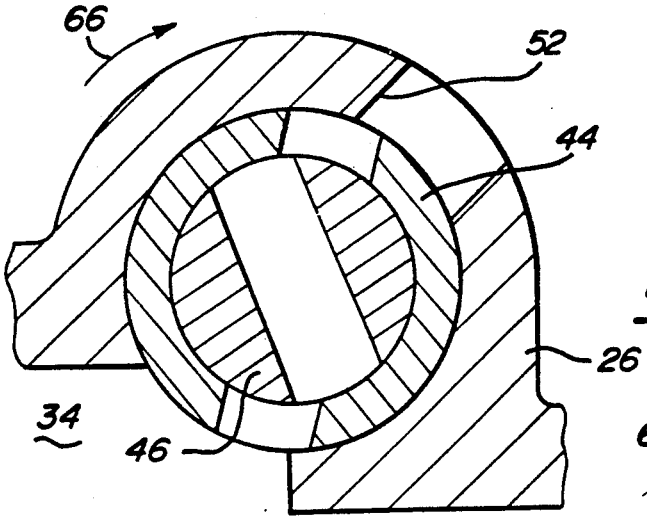
FIG. 5 is an enlarged view of one of the valve units shown in FIG. 2 showing the valve unit in an advanced opening state.

Referring to FIGS. 1 and 2, a section through a typical internal combustion engine is shown. While the description of the preferred embodiment will be generally directed towards a four-stroke internal combustion engine, it is to be understood that the rotary valve system of the present invention is equally applicable to a two-stroke engine or any other type of engine having intake and/or exhaust valves. The internal combustion engine 10 comprises the typical engine block 12 having water cooling passage 14 therethrough. Water, for cooling, is circulated through the passages 14 in a conventional manner (not shown). Pistons 16 are fitted in cylinders 18 and are coupled through connecting rods 20 to the arms of a crankshaft 22 which is rotatably mounted in engine block 12 for rotation about an axis 24.

A cylinder head 26 in the form of a housing is secured to engine block 12 by bolts 28 which also clamps a gasket 30 therebetween. Each piston 16 may have a concave cavity 32 in the head thereof to partly form a combustion chamber 34. A spark plug 36 is mounted in head 26 centrally of each cylinder and is fired by a conventional ignition system (not shown). While cylinder head 26 is being shown as a separate piece from engine block 12 and secured to engine block 12 by bolts 28, it is within the scope of this invention to provide a head which is integral with engine block 12. The integral head would eliminate the need for bolts 28 and gasket 30 as both head 26 and block 12 would be formed as a single piece.

A rotary intake valve assembly 40 and a rotary exhaust valve assembly 42 are provided, extending the length of engine block 12. Intake valve assembly 40 comprises a tubular sleeve 44 and a cylindrical valve body 46. Tubular sleeve 44 is rotatably mounted within cylinder head 26 as shown in FIGS. 1 and 2. A pair of circumferentially spaced generally rectangular slots 48 extend completely through tubular sleeve 44. Cylindrical valve body 46 is rotatably mounted within and coaxial with tubular sleeve 44. Valve body 46 has a generally rectangular slot 50 extending through valve body 46 perpendicular to the axis of rotation as shown in FIGS. 1, 2 and 4. The width and length of rectangular slot 50 is similar in width and length to the pair of slots 48 located in tubular sleeve 44. An input passage 52 extends from an intake manifold (not shown) through cylinder head 26 and opens into combustion chamber 34. When rectangular slot 50 of valve body 46 is aligned with the pair of slots 48 of sleeve 44 and these are in turn aligned with input passage 52 of cylinder head 26, the valve is open and an input charge is allows to flow from the intake manifold to combustion chamber 34. When these slots 48, 50 are not in alignment with intake passage 52 (as shown in the exhaust valve assembly of FIGS. 1 and 2), the valve is closed and combustion chamber 34 is sealed from the intake manifold.

Exhaust valve assembly 42 comprises a tubular sleeve 54 and a cylindrical valve body 56. Tubular sleeve 54 is rotatably mounted within cylinder head 26 as shown in FIGS. 1 and 2. A pair of circumferentially spaced generally rectangular slots 58 extend completely through tubular sleeve 54. Cylindrical valve body 56 is rotatably mounted within and coaxial with tubular sleeve 54. Valve body 56 has a generally rectangular slot 60 extending through valve body 56 perpendicular to the axis of rotation as shown in FIGS. 1 and 2. The width and length of rectangular slot 60 is similar in width and length to the pair of slots 58 located in tubular sleeve 54. The size of slots 58 and 60 are not necessarily the same size as slots 48 and 50 respectively. It may be advantageous to have different sized intake and exhaust valves. Exhaust valve sleeve 54 and exhaust body 56 are similar to intake valve sleeve 44 and intake valve body 46 shown in FIGS. 3 and 4, respectively. An exhaust passage 62 extends from an exhaust manifold (not shown) through cylinder head 26 and opens into combustion chamber 34. When rectangular slot 60 of valve body 56 is aligned with the pair of slots 58 of sleeve 54 and these are in turn aligned with exhaust passage 62 of cylinder head 26, the exhaust valve is open and the combustion products within combustion chamber 34 are allowed to flow from combustion chamber 34 to the exhaust manifold. When these slots 58, 60 are not in alignment with exhaust passage 62, the exhaust valve is closed and combustion chamber 34 is sealed from the exhaust manifold.

Under normal engine operating conditions, slots 48 and 58 are aligned with slots 50 and 60 respectively and sleeves 44 and 54 rotate together with valve bodies 46 and 56 respectively. The rotating of valve assemblies 40 and 42 are synchronized with the rotation of crankshaft 22, in a manner known in the art, such that alignment of slots 48 and 50 with input passage 52 occurs only during a downward intake stroke of piston 16 and alignment of slots 58 and 60 with exhaust passage 62 occurs only during an upward exhaust stroke of piston 16. The specific speeds will be determined by whether a two-stroke or four-stroke internal combustion engine is being operated. The rotation of sleeves 44 and 54 and valve bodies 46 and 56 are timed to rotate with the crankshaft as mentioned above but they are also allowed to advance or retard their rotation either mechanically or electronically relative to the crankshaft by methods known in the art.

Figure 6:
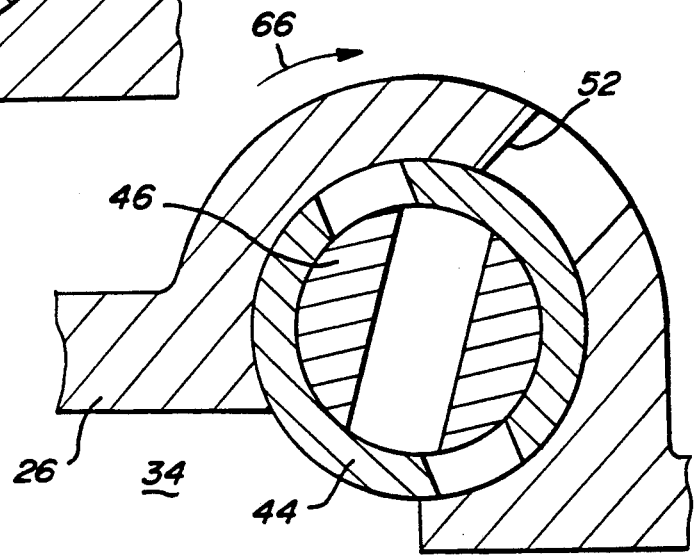
FIG. 6 is an enlarged cross sectional view of one of the valve units shown in FIG. 2 showing the valve unit in a retarded state.

FIGS. 5 and 6 illustrate the positioning of input sleeve 44 with respect to input valve body 46 in order to advance and retard, respectively, the opening of input passage 52 to combustion chamber 34. While the specification will detail the specifics for advancing and retarding the input flow to combustion chamber 34, it is to be understood that a similar description can be applied to the advancing and retarding of the opening of the exhaust flow from combustion chamber 34.

When it is desired to advance the opening of the input flow to combustion chamber 34, the rotational speed of sleeve 44 is increased with respect to valve body 46 such that input passage 52 is in communication with combustion chamber 34 prior to slot 50 aligning with input passage 52. This rotational speed difference can be accomplished by increasing the rotational speed of sleeve 44 or decreasing the rotational speed of valve body 46 or a combination of each. This relationship is shown in FIG. 5. The rotational direction of valve sleeve 44 and valve body 46 is shown by arrow 66. As can be seen in FIG. 5, input charge from input passage 52 is allowed to flow through one of the slots 48, through slot 50, through the second slot 48 and into combustion chamber 34. Sleeve 44 creates a flow path prior to the alignment of slot 50 with input passage 52.

When it is desired to retard the opening of input flow to combustion chamber 34, the rotational speed of sleeve 44 is decreased with respect to valve body 46 such that input passage 52 is in communication with combustion chamber 34 prior to slot 50 aligning with input passage 52. This rotational speed difference can be accomplished by increasing the rotational speed of sleeve 44 or decreasing the rotational speed of valve body 46 or a combination of each. This relationship is shown in FIG. 5. The rotational direction of valve sleeve 44 and valve body 46 is shown by arrow 66. As can be seen in FIG. 5, input charge from input passage 52 is allowed to flow through one of the slots 48, through slot 50, through the second slot 48 and into combustion chamber 34. Sleeve 44 creates a flow path prior to the alignment of slot 50 with input passage 52.

When it is desired to retard the opening of input flow to combustion chamber 34, the rotational speed of sleeve 44 is decreased with respect to valve body 46 such that input passage 52 does not communicate with combustion chamber 34 when slot 50 is aligned with input passage 52. This rotational speed difference can be accomplished by decreasing the rotational speed of sleeve 44 or increasing the rotational speed of valve body 46 or a combination of each. This relationship is shown in FIG. 6. Again, the rotational direction of valve sleeve 44 and valve body 46 is shown by arrow 66. As can be seen in FIG. 6, input charge from input passage 52 is not allowed to flow through slots 48 and slot 50. Sleeve 44 maintains the seal of the flow path until a specific period beyond the time when slot 50 is aligned with input passage 52. In a similar manner, the closing of the valve and/or the duration of the time the valve is open can be adjusted by controlling the relationship between the valve sleeve and the valve body.

In another embodiment of the present invention, sleeves 44 and 54 do not continuously rotate with valve bodies 45 and 56, respectively. Sleeves 44 and 54 are stationary and are then selectively rotated to advance or retard the timing of the valve opening or closing similar to the illustrations shown in FIGS. 5 and 6. Under normal engine operating conditions, the sleeves 44 and 54 remain stationary in a position illustrated by the intake valve of FIG. 2. When it is desired to advance the opening of either the intake valve or the exhaust valve, sleeve 44 or 54 is selectively rotated to a position similar to that shown in FIG. 5. When it is desired to retard the opening of either the intake valve or the exhaust valve, sleeve 44 or 54 is selectively rotated to a position similar to that shown in FIG. 6. The operation of the other components of this embodiment are identical to those described above. Also, in a similar manner, the closing of the valve and/or the duration of time the valve is open can be adjusted by controlling the relationship between valve sleeve 44 and valve body 46 or valve sleeve 54 and valve body 56.

Figure 7:
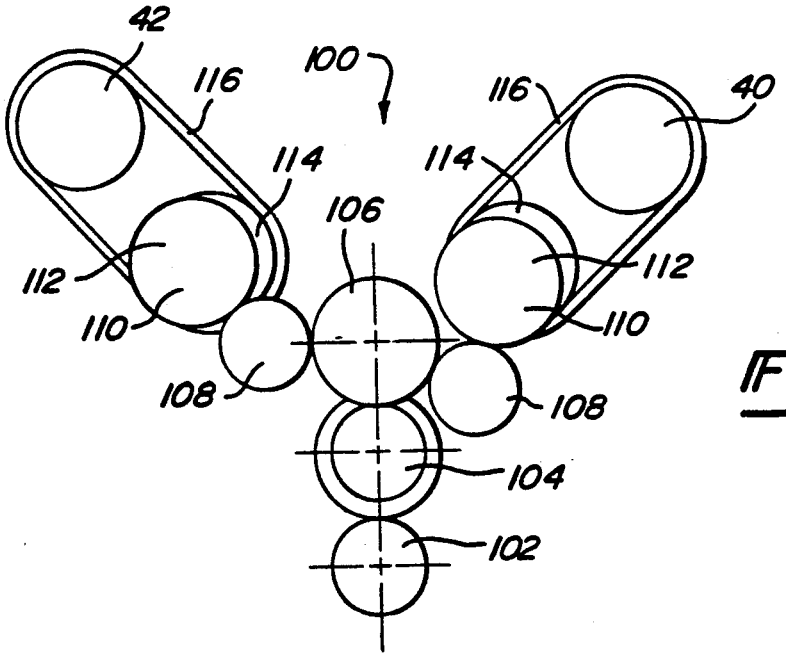
FIG. 7 is a driving arrangement for the rotary valve system.

FIG. 7 shows a drive system 100 for valve assemblies 40 and 42 according to another embodiment of the present invention. This embodiment will be described having slots 48 and 50 and slots 58 and 60 in alignment. It is to be understood that the advancing and retarding of the valve openings as described above can be applied to this embodiment also. The embodiment described for FIGS. 1 through 6 was described utilizing a drive system which, under normal engine operating conditions, has the rotational speed of the valve bodies 46 and 56 and the sleeves 44 and 54 at a constant speed in relation to a given speed of crankshaft 22. The amount of time that slots 48 and 50 or 58 and 60 are aligned with passages 52 and 62, respectively, is a constant duration which can be related back to the number of degrees of rotation of crankshaft 22 since the rotational speed of valve assemblies 40 and 42 is synchronized with the rotation of crankshaft 22. Under various circumstances, it may be desirable to increase the duration in which the intake valve assembly 40 and/or the exhaust valve assembly 42 interconnect the intake passage 52 and exhaust passage 62, respectively, with combustion chamber 34. The drive system 100 shown in FIG. 7 provides for this increase in valve opening duration.

The example shown in FIG. 7 is for a four cycle engine and comprises a crankshaft which rotates a crankshaft gear 102 at crankshaft speed. Gear 102 is meshed with reduction gear 104 to reduce the rotational speed of the valve assemblies 40 and 42. Gear 104 is meshed with a second reduction gear 106 to further reduce the rotational speed of the valve assemblies 40 and 42. Gear 106 is meshed with a pair of movable idler gears 108. Idler gears 108 are movable in order to maintain engagement with eccentric gears 110 as will be described later herein.

Each idler gear 108 is meshed with a respective eccentric gear 110 which is part of a composite gear 112 and provides additional reduction of the rotational speed. Each composite gear 112 comprises eccentric gear 110 and a drive sprocket 114. Drive sprocket 114 rotates about its centerline driven by eccentric gear 110 which is fixedly attached to drive sprocket 114 with the centerline of eccentric gear 110 being spaced a specific distance from the centerline of drive sprocket 114 to create the eccentric relationship. Drive sprocket 114 drives valve assemblies 40 and 42 via endless cog belts 116. Eccentric gears 110 thus drive sprockets 114 in a non-uniform manner by their engagement with idler gears 108. Idler gear 108 are movable along a preset path to insure continuous engagement with eccentric gear 110. Idler gears 108 may be loaded hydraulically or with springs in order to insure the engagement with eccentric gear 110.

The drive system shown in FIG. 7 thus allows the rotational speed of intake and exhaust valve assemblies 40 and 42 to be slowed down during the times that the intake and/or exhaust passages 52 and 62, respectively, are open to combustion chamber 34 by selecting the proper amount of eccentricity and the proper angular relationship between the various gears going back to crankshaft 22.

While the above detailed description describes the preferred embodiment of the present invention, it is to be understood that the present invention is susceptible to modification, variation and alteration without deviating from the scope and fair meaning of the subjoined claims.

What is claimed is:

1. An engine apparatus for obtaining variable intake valve timing in an internal combustion engine comprising at least one cylinder and a crankshaft, said apparatus comprising:

a support member having an internal cylindrical cavity, said cylindrical cavity in communication with each cylinder of said internal combustion engine, said support member having at least one port connecting said cylindrical cavity to a source of intake change;

a valve sleeve rotatably disposed within said cylindrical cavity, said valve sleeve having first porting means for connecting said source of intake charge with each of said cylinders of said internal combustion engine;

a valve body rotatably disposed within said valve sleeve, said valve body having second porting means for connecting said source of intake charge with each of said cylinders of said internal combustion engine;

means for rotating said valve sleeve in synchronized relationship to the rotation of said crankshaft of said internal combustion engine;

means for rotating said valve body in synchronized relationship to the rotation of said crankshaft of said internal combustion engine; and means for varying the rotational speed of said valve sleeve with respect to said crankshaft wherein the point at which effective communication between said source of input charge and each of said cylinders of said internal combustion engine can be advanced or retarded.

2. The apparatus of claim 1 further comprising means for varying the rotational speed of said valve body with respect to said crankshaft wherein the point at which effective communication between said source of intake charge and each of said cylinders of said internal combustion engine can be advanced or retarded.

3. The apparatus of claim 1 wherein said means for rotating said valve body rotates said valve body at a non-uniform rotational speed such that the amount of time said source of input charge is in communication with each of said cylinders of said internal combustion engine is increased.

4. The apparatus of claim 3 wherein said means for rotating said valve body comprises a plurality of sprockets at least one sprocket of said plurality of sprockets being a compound eccentric sprocket.

5. The apparatus of claim 1 wherein said means for rotating said valve sleeve rotates said valve sleeve at a non-uniform rotational speed such that the amount of time said source of input charge is in communication with each of said cylinders of said internal combustion engine is increased.

6. The apparatus of claim 5 wherein said means for rotating said valve sleeve comprises a plurality of sprockets, at least one sprocket of said plurality of sprockets being a compound eccentric sprocket.

7. An engine apparatus for obtaining variable exhaust valve timing in an internal combustion engine comprising at least one cylinder and a crankshaft, said apparatus comprising:

a support member having an internal cylindrical cavity, said cylindrical cavity in communication with each cylinder of said internal combustion engine, said support member having at least one port connecting said cylindrical cavity to an exhaust system;

a valve sleeve rotatably disposed within said cylindrical cavity, said valve sleeve having first porting means for connecting each of said cylinders of said internal combustion engine with said exhaust system;

a valve body rotatably disposed within said valve sleeve, said valve body having second porting means for connecting each of said cylinders of said internal combustion engine with said exhaust system;

means for rotating said valve sleeve in synchronized relationship to the rotation of said crankshaft of said internal combustion engine;

means for rotating said valve body in synchronized relationship to the rotation of said crankshaft of said internal combustion engine; and means for varying the rotational speed of said valve sleeve with respect to said crankshaft wherein the point at which effective communication between each of said cylinders of said internal combustion engine and said exhaust system can be advanced or retarded.

8. The apparatus of claim 7 further comprising means for varying the rotational speed of said valve body with respect to said crankshaft wherein the point at which effective communication between each of said cylinders of said internal combustion engine and said exhaust system can be advanced or retarded.

9. The apparatus of claim 7 wherein said means for rotating said valve body rotates said valve body at a non-uniform rotation speed such that the amount of time each of said cylinders of said internal combustion engine is in communication with said exhaust system is increased.

10. The apparatus of claim 9 wherein said means for rotating said valve body comprises a plurality of sprockets at least one sprocket of said plurality of sprockets being a compound eccentric sprocket.

11. The apparatus of claim 7 wherein said means for rotating said valve sleeve rotates said valve sleeve at a non-uniform rotational speed such that the amount of time each of said cylinders of said internal combustion engine is in communication with said exhaust system is increased.

12. The apparatus of claim 11 wherein said means for rotating said valve sleeve comprises a plurality of sprockets, at least one sprocket of said plurality of sprockets being a compound eccentric sprocket.

13. An engine apparatus for obtaining variable intake and exhaust valve timing in an internal combustion engine comprising at least one cylinder and a crankshaft, said apparatus comprising:

a support member having a first and second internal cylindrical cavity, said first and second cylindrical cavities in communication with each cylinder of said internal combustion engine, said support member having at least one intake port connecting said first cylindrical cavity to a source of intake charge and at least one exhaust port connecting said second cylindrical cavity to an exhaust system;

a first and second valve sleeve rotatably disposed within said first and second cylindrical cavities, respectively, said first valve sleeve having first input porting means for connecting said source of intake charge with each of said cylinders of said internal combustion engine, said second valve sleeve having first exhaust porting means for connecting each of said cylinders of said internal combustion engine with said exhaust system;

a first and second valve body rotatably disposed within said first and second valve sleeves, respectively, said first valve body having second input porting means for connecting said source of intake charge with each of said cylinders of said internal combustion engine, said second valve body having second exhaust porting means for connecting each of said cylinders of said internal combustion engine with said exhaust system;

means for rotating said first and second valve sleeves in synchronized relationship to the rotation of said crankshaft of said internal combustion engine;

means for rotating said first and second valve bodies in synchronized relationship to the rotation of said crankshaft of said internal combustion engine; and means for varying the rotational speed of said first and second valve sleeves with respect to said crankshaft wherein the point at which effective communication between said source of input charge and each of said cylinders of said internal combustion engine can be advanced or retarded, and the point at which effective communication between each of said cylinders of said internal combustion engine and said exhaust system can be advanced or retarded.

14. The apparatus of claim 13 further comprising means for varying the rotational speed of said first and second valve bodies with respect to said crankshaft wherein the point at which effective communication between said source of input charge and each of said cylinders of said internal combustion engine can be advanced or retarded, and the point at which effective communication between each of said cylinders of said internal combustion engine and said exhaust system can be advanced or retarded.

15. The apparatus of claim 13 wherein said means for rotating said first and second valve bodies rotates said first and second valve bodies at a non-uniform rotational speed such that the amount of time said source of input charge is in communication with each of said cylinders of said internal combustion engine is increased, and the amount of time each of said cylinders of said internal combustion engine is in communication with said exhaust system is increased.

16. The apparatus of claim 15 wherein said means for rotating said first and second valve bodies comprises a plurality of sprockets, at least one sprocket of said plurality of sprockets being a compound eccentric sprocket.

17. The apparatus of claim 13 wherein said means for rotating said first and second valve sleeves rotates said first and second valve sleeves at a non-uniform rotation speed such that the amount of time said source of input charge is in communication with each of said cylinders of said internal combustion engine is increased, and the amount of time each of said cylinders of said internal combustion engine is in communication with said exhaust system is increased.

18. The apparatus of claim 15 wherein said means for rotating said first and second valve sleeves comprises a plurality of sprockets, at least one sprocket of said plurality of sprockets being a compound eccentric sprocket.

19. An engine apparatus for obtaining variable intake valve timing in an internal combustion engine comprising at least one cylinder and a crankshaft, said apparatus comprising:

a support member having an internal cylindrical cavity, said cylindrical cavity in communication with each cylinder of said internal combustion engine, said support member having at least one port connecting said cylindrical cavity to a source of intake charge;

a valve sleeve rotatably disposed within said cylindrical cavity, said valve sleeve having first porting means for connecting said source of intake charge with each of said cylinders of said internal combustion engine;

a valve body rotatably disposed within said valve sleeve, said valve body having second porting means for connecting said source of intake charge with each of said cylinders of said internal combustion engine;

means for continuously rotating said valve body in synchronized relationship to the rotation of said crankshaft of said internal combustion engine wherein said means for continuously rotating said valve body rotates said valve body at a non-uniform rotational speed such that the amount of time said source of input charge is in communication with each of said cylinders of said internal combustion engine is increased; and means for selectively rotating said valve sleeve such that the point at which effective communication between said source of input charge and each of said cylinders of said internal combustion engine can be advanced or retarded.

20. The apparatus of claim 19 wherein said means for rotating said valve body comprises a plurality of sprockets at least one sprocket of said plurality of sprockets being a compound eccentric sprocket.

21. An engine apparatus for obtaining variable exhaust valve timing in an internal combustion engine comprising at least one cylinder and a crankshaft, said apparatus comprising:

a support member having an internal cylindrical cavity, said cylindrical cavity in communication with each cylinder of said internal combustion engine, said support member having at least one port connecting said cylindrical cavity to an exhaust system;

a valve sleeve rotatably disposed within said cylindrical cavity, said valve sleeve having first porting means for connecting each of said cylinders of said internal combustion engine with said exhaust system;

a valve body rotatably disposed within said valve sleeve, said valve body having second porting means for connecting each of said cylinders of said internal combustion engine with said exhaust system;

means for continuously rotating said valve body in synchronized relationship to the rotation of said crankshaft of said internal combustion engine wherein said means for continuously rotating said valve body rotates said valve body at a non-uniform rotational speed such that the amount of time each of said cylinders of said internal combustion engine is in communication with said exhaust system is increased; and means for selectively rotating said valve sleeve such that the point at which effective communication between each of said cylinders of said internal combustion engine and said exhaust can be advanced or retarded.

22. The apparatus of claim 21 wherein said means for rotating said valve body comprises a plurality of sprockets at least one sprocket of said plurality of sprockets being a compound eccentric sprocket.

23. An engine apparatus for obtaining variable intake and exhaust valve timing in an internal combustion engine comprising at least one cylinder and a crankshaft, said apparatus comprising:

a support member having a first and second internal cylindrical cavity, said first and second cylindrical cavities in communication with each cylinder of said internal combustion engine, said support member having at least one intake port connecting said first cylindrical cavity to a source of intake charge and at least one exhaust port connecting said second cylindrical cavity to an exhaust system;

a first and second valve sleeve rotatably disposed within said first and second cylindrical cavities, respectively, said first valve sleeve having first input porting means for connecting said source of intake charge with each of said cylinders of said internal combustion engine, said second valve sleeve having first exhaust porting means for connecting each of said cylinders of said internal combustion engine with said exhaust system;

a first and second valve body rotatably disposed within said first and second valve sleeves, respectively, said first valve body having second input porting means for connecting said source of intake charge with each of said cylinders of said internal combustion engine, said second valve body having second exhaust porting means for connecting each of said cylinders of said internal combustion engine with said exhaust system;

means for continuously rotating said first and second valve bodies in synchronized relationship to the rotation of said crankshaft of said internal combustion engine wherein said means for continuously rotating said first and second valve bodies rotates said first and second valve bodies at a non-uniform rotational speed such that the amount of time said source of input charge is in communication with each of said cylinders of said internal combustion engine is increased, and the amount of time each of said cylinders of said internal combustion engine is in communication with said exhaust system is increased; and means for selectively rotating said first and second valve sleeves such that the point at which effective communication between said source of input charge and each of said cylinders of said internal combustion engine can be advanced of retarded, and the point at which effective communication between each of said cylinders of said internal combustion engine and said exhaust system can be advanced or retarded.

24. The apparatus of claim 23 wherein said means for rotating said first and second valve bodies comprises a plurality of sprockets, at least one sprocket of said plurality of sprockets being a compound eccentric sprocket.

* * * * *

UNITED STATES PATENT AND TRADEMARK OFFICE

CERTIFICATE OF CORRECTION

PATENT NO. : 5,205,251

DATED : April 27, 1993

INVENTOR(S) : Ronald J. Conklin

It is certified that error appears in the above-identified patent and that said Letters Patent is hereby corrected as shown below:

ON THE TITLE PAGE, under "Abstract", line 3,
"of" should be --or--.

Column 1, line 17,
"comprises" should be --comprise--.

Column 1, line 45,
"valve" should be --valves--.

Column 1, line 47,
"as" should be --at--.

Column 1, line 55,
"an" should be --at--.

Column 2, line 9,
"an" should be --at--.

Column 2, line 51,
"rotation" should be --rotatable--.

Column 3, line 32,
"passage" should be --passages--.

Column 4, line 4,
"allows" should be --allowed--.

Column 4, line 50,
"speeds" should be --speed--.

UNITED STATES PATENT AND TRADEMARK OFFICE

CERTIFICATE OF CORRECTION

PATENT NO. : 5,205,251

DATED : April 27, 1993

INVENTOR(S) : Ronald J. Conklin

It is certified that error appears in the above-identified patent and that said Letters Patent is hereby corrected as shown below:

Column 5, lines 15 - 30,

Delete "When it is desired to retard the opening of input flow to combustion chamber 34, the rotational speed of sleeve 44 is decreased with respect to valve body 46 such that input passage 52 is in communication with combustion chamber 34 prior to slot 50 aligning with input passage 52. This rotational speed difference can be accomplished by increasing the rotational speed of sleeve 44 or decreasing the rotational speed of valve body 46 or a combination of each. This relationship is shown in Fig. 5. The rotational direction of valve sleeve 44 and valve body 46 is shown by arrow 66. As can be seen in Fig. 5, input charge from input passage 52 is allowed to flow through one of the slots 48, through slot 50, through the second slot 48 and into combustion chamber 34. Sleeve 44 creates a flow path prior to the alignment of slot 50 with input passage 52."

Column 5, line 52

"45" should be --46--.

Column 5, line 65

"of" should be --for--.

Column 6, line 52

"gear" should be --gears--.

Column 7, line 13, claim 1

"change" should be --charge--.

Column 9, line 57, claim 17

"rotation" should be --rotational--.

UNITED STATES PATENT AND TRADEMARK OFFICE

CERTIFICATE OF CORRECTION

PATENT NO. : 5,205,251

DATED : April 27, 1993

INVENTOR(S) : Ronald J. Conklin

It is certified that error appears in the above-identified patent and that said Letters Patent is hereby corrected as shown below:

Column 11, line 4, claim 21
after "exhaust", insert --system--.

Column 12, line 24, claim 23
"of" should be --or--.

Signed and Sealed this

Fifteenth Day of March, 1994

*Attest:*

Bruce Lehman

BRUCE LEHMAN

*Attesting Officer*

*Commissioner of Patents and Trademarks*